United States Patent [19]

Taniwaki

[11] 4,153,312

[45] May 8, 1979

[54] MOBILE RACK SYSTEM

[75] Inventor: Genshi Taniwaki, Kumamoto, Japan

[73] Assignee: Kongo Co., Ltd., Kumamoto, Japan

[21] Appl. No.: 823,941

[22] Filed: Aug. 11, 1977

[30] Foreign Application Priority Data

Aug. 12, 1976 [JP] Japan ..... 51-108143[U]

[51] Int. Cl.[2] ..... A47B 87/00

[52] U.S. Cl. ..... 312/198; 312/200; 105/86; 188/31; 297/349

[58] Field of Search ..... 312/197, 198, 199, 200; 105/462, 91-95, 86; 188/26, 31, 71.1; 297/349

[56] References Cited

U.S. PATENT DOCUMENTS

| | | | |
|---|---|---|---|
| 547,019 | 10/1895 | Miller | 105/91 |
| 753,106 | 2/1904 | Pierce | 105/91 |
| 1,058,166 | 4/1913 | Evans | 188/31 |
| 1,119,568 | 12/1914 | Blood | 105/462 |
| 1,402,127 | 1/1922 | Wilson | 105/91 |
| 1,798,808 | 3/1931 | Potter | 188/31 |
| 3,200,907 | 8/1965 | Hansen | 188/31 |
| 3,878,921 | 4/1975 | Kibler et al. | 188/26 |
| 3,923,354 | 12/1975 | Young | 312/198 |
| 3,944,309 | 3/1976 | Taniwaki | 312/198 |
| 4,059,171 | 11/1977 | Pakosh | 297/349 |

FOREIGN PATENT DOCUMENTS

| | | | |
|---|---|---|---|
| 256210 | 10/1964 | Australia | 312/198 |
| 170353 | 2/1960 | Sweden | 312/198 |

*Primary Examiner*—Victor N. Sakran

*Attorney, Agent, or Firm*—Armstrong, Nikaido, Marmelstein & Kubovcik

[57] ABSTRACT

Disclosed is a mobile rack system intended for an efficient use of a limited space of store house and the like for storing books and other goods, having a plurality of mobile racks adapted to run along rails laid on the floor of the store house. The system incorporates at least one human-power driven pedal-actuated driving source. The driving source may be provided for each of the mobile racks or may be provided independently of the mobile racks for running along separate rails. The driving source has a pair of pedals, at least a pair of driving wheels, speed reduction transmitting means between the pedals and the driving wheels, and a saddle for the operator to sit on, the position of which being switchable in accordance with the direction of movement of the rack or the tractor.

Braking means are provided for preventing the mobile racks from moving unintentionally, thereby to avoid accidents due to the collision of racks.

7 Claims, 13 Drawing Figures

MOBILE RACK SYSTEM

BACKGROUND OF THE INVENTION

The present invention relates to a mobile rack system having a plurality of wheeled mobile storage racks adapted to run along rails installed on a floor of limited storage space such as of a store and the like.

It is not good, from a view point of efficient use of a limited space of a room, to fixedly situate a number of racks accommodating books and other goods on the floor of the rooms with spaces left between the adjacent racks.

Thus, for making an efficient use of a limited space, so-called mobile rack system is getting popular, which employs a number of wheeled power driven or manually actuated mobile racks adapted to run along rails installed on the floor of the room, so as to preserve a space for access only between specific positions of racks. Most of the conventional manually actuated mobile racks are provided at their sides with members by means of which the human power is exerted to push and move the rack.

Also, some of the conventional manually actuated mobile racks incorporate a rotary handle provided at one side of the rack and operatively connected, through a chain or the like transmission mechanism, to a driving axle of driving wheels. The arrangement is such that a man standing by the rack rotates the handle to drive the driving wheels so that the wheels are driven to roll along the rails to move the rack to the desired position. For informations, this type of mobile rack system is disclosed in the specification of U.S. Pat. No. 3,944,309.

Although these manually actuated mobile rack systems are advantageous in that they are simple in construction and are costless as compared with power driven type mobile racks in which each rack carries an electric motor or the like power source, they are not suitable for heavy-load racks accommodating a large weight of contents, because the man standing by the rack can no more move the rack in such a case, by simply pushing the rack nor by rotating the handle.

At the same time, it has been pointed out that, in the conventional rack system, the racks are tend to move unintentionally, especially when the rails are not horizontal, to cause a collision of the racks and, accordingly, a collapse of the goods mounted on the rack. In the worst case, the operator who is working in the passage of the racks for loading and unloading the racks may be accidentally injured by the racks.

In addition, in the conventional manually operated mobile rack system, each of the racks is provided with its own driving mechanism, which is quite uneconomical from viewpoints of manufacture and space utilization.

Under these circumstances, the present invention is aiming at overcoming above described problems of the prior art by providing an improved mobile rack system.

It is therefore an object of the invention to provide an improved mobile rack system in which the racks can be easily moved manually, even when they are loaded with heavy loads.

It is another object of the invention to provide a manually actuated mobile rack system in which the unintentional movement of the racks, which may cause a collision of racks or collapse of goods, is fairly avoided.

It is still another object of the invention to provide a mobile rack system in which a plurality of racks are moved by a single driving means, thereby to economize the space and to reduce the cost of manufacture.

To these ends, according to the invention, there is provided a mobile rack system having a plurality of rails, and a plurality of mobile racks adapted to run along said rails, each of said wheels having a seat for an operator, pedal means mounted for operation by the operator on the seat, driving wheels adapted to be actuated by said pedal means through a transmission means.

According to another aspect of the invention, the pedal means are associated with suitable braking means which are effective to prevent the racks from moving unintentionally, thereby to avoid the aforementioned accidents. According to still another aspect of the invention, the mobile rack system incorporates a tractor adapted to run along a separate rail to pull the mobile rack.

These and other objects, as well as advantageous features of the invention will become clear from the following description of the preferred embodiments taken in conjunction with the attached drawings in which:

BRIEF DESRIPTION OF THE DRAWINGS

FIG. 1 is a perspective view of an unit of a mobile rack mounted on rails for free running thereon, in accordance with the invention, FIG. 2 is a plan view of a plurality of units of the mobile rack of FIG. 1 arrayed on the rails, in which a frame portion of the left-hand side end rack has been removed to show the driving system provided thereunder, FIG. 3 is a partially sectioned side elevational view of an operator's seat associated with pedal means, FIG. 4 is a sectional view taken along the broken line IV—IV of FIG. 2, FIG. 5 is a sectional view taken along the broken line V—V of FIG. 2, FIG. 6 is a sectional view taken along the broken line VI—VI of FIG. 2, FIG. 7 is a view similar to FIG. 2 but showing a second embodiment of the invention, FIG. 8 is an enlarged view of braking means incorporated in the construction of FIG. 7.

FIG. 9 is a sectional view taken along the line IX—IX of FIG. 8,

FIG. 10 is a view similar to that of FIG. 8 but showing different manner of operation, FIG. 11 is a plan view of a third embodiment of the invention showing several units of mobile racks arrayed on rails, FIG. 12 is a partially sectioned side elevational view of a tractor incorporated in the mobile rack system of FIG. 11, and FIG. 13 is a front elevational view of a construction through which the tractor of FIG. 12 is connected to a mobile rack.

DESCRIPTION OF PREFERRED EMBODIMENTS

Hereinafter, preferred embodiments of the invention will be described with reference to the drawings.

Figure 1:
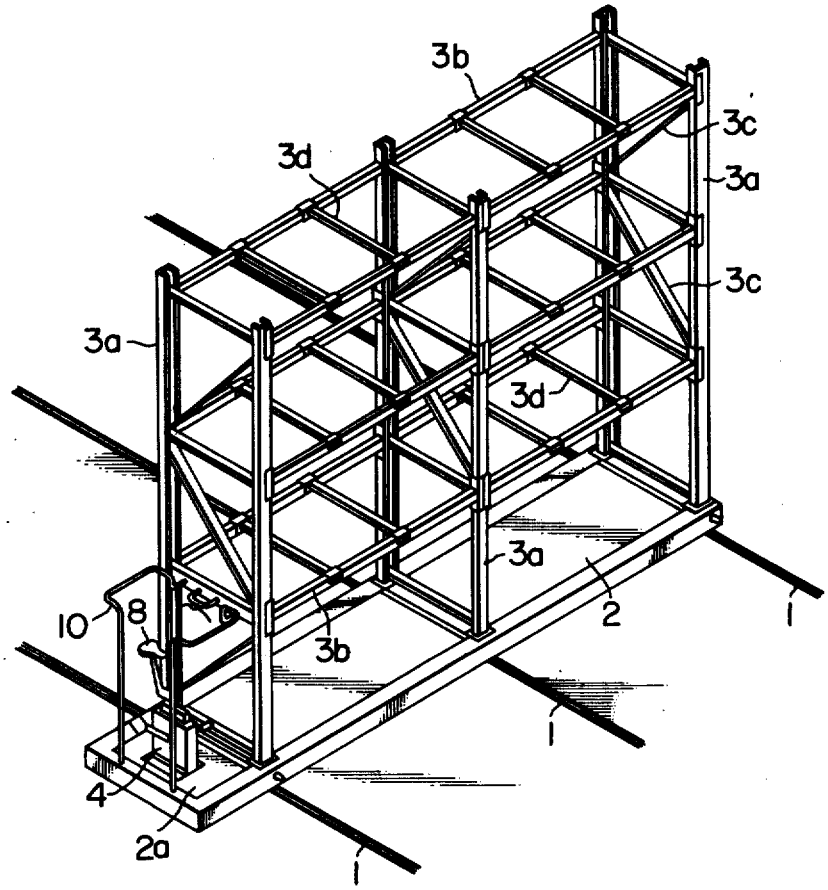
Figure 4:
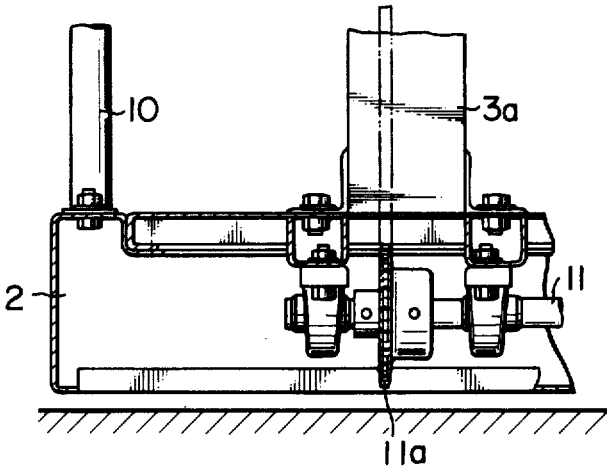
Figure 5:
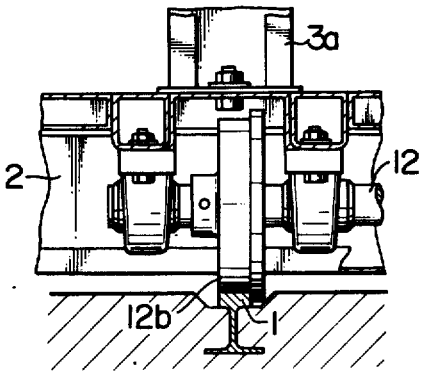
Figure 6:
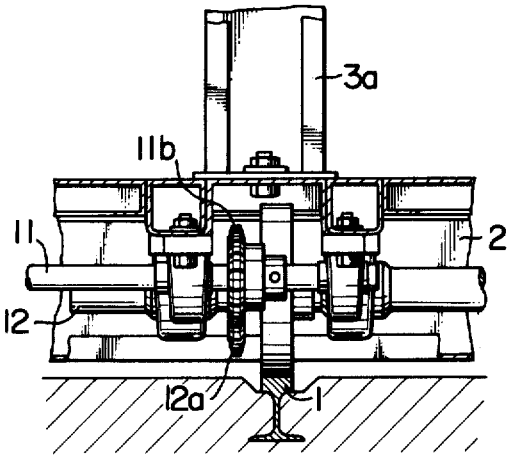
Figure 7:
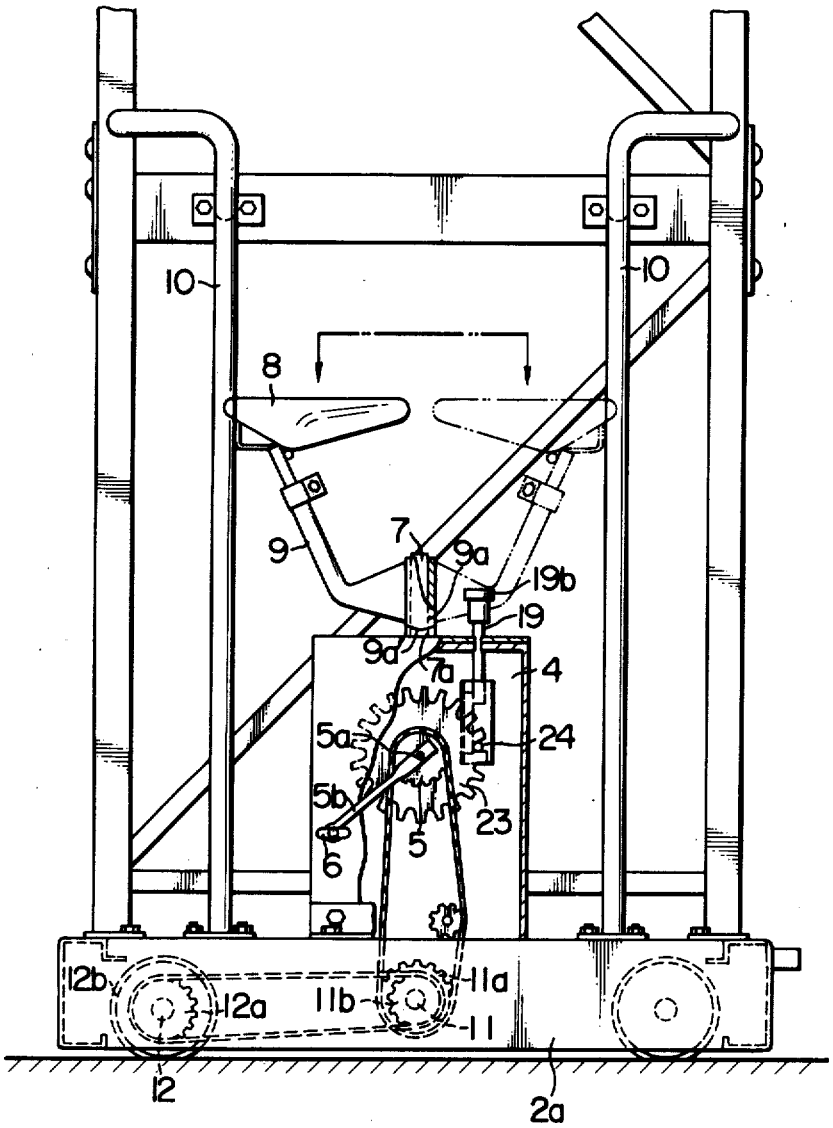

Referring at first to FIG. 1 showing a perspective view of a mobile rack in accordance with the first embodiment of the invention movably mounted on parallel rails 1. The rack has a frame situated on a base 2 which is in the form of an inversed shallow box, as will be seen from FIGS. 4 to 6. The frame includes pillars 3a consisting of channel steel bars standing up from the base 2, beams 3b, reinforcing members 3c and so on. Girders 3d for supporting the weight of the goods are provided to bridge the beams 3b. The base 2 is extended at its one end outwardly from the frame to provide a bed 2a for the operator's seat. The bed 2a carries a pedal means which is detailed in FIG. 3. More specifically, the bed 2a carries a box-shaped frame 4 having no bottom. A shaft 5a for primary wheel 5 is mounted bridging a pair of opposing walls of the box-shaped frame 4. Both ends of the shaft 5a project out of the box-shaped frame 4 to be attached by respective one of a pair of arms 5b which in turn carries at their free ends respective pedals 6 similar to those of bicycles.

A vertical pipe 7 is provided at the center of the top wall of the box-shaped frame to extend upwardly therefrom. A tubular member 9a unitary with a support 9 for a saddle 8 is loosely fitted around the vertical pipe 7 coaxially with the latter, so that the support 9 along with the saddle 8 is allowed to freely turn around the pipe 7. Thus, the saddle can assume both positions as illustrated by full line and broken line in FIG. 3. For fixing the saddle at positions suitable for the driving, the tubular member 9a is provided at its lower surface with V-shaped notched portions 9a' for engagement with V-shaped projections formed on the upper surface of an enlarged root portion 7a of the pipe 7.

For shifting the saddle from the position of full line to that of broken line and vice versa, the saddle is simply lifted so that the V-shaped notches and projections may clear each other, rotated through 180° around the pipe 7, and then lowered so as to bring the V-shaped notches and projections into mutual engagement. Then, the saddle can by no means rotate against the operator's will.

Hand rails 10 which play also the role of seat backs are provided behind respective positions of the saddle. The rotation of the pedal-actuated primary wheel 5 is transmitted, through a belt or a chain, to an intermediate wheel 11a rotatably supported on a shaft 11 carried by the base 2 at the lower portion of the latter. The intermediate wheel 11a in turn is connected, through a belt or a chain, to a wheel 12a coaxially fixed to a driving shaft 12 which carries at least one driving wheel 12b. Therefore, as the human power is exerted on the pedal, the resultant torque is transmitted to the driving wheels 12b so as to make the latter roll on the associated rails. Preferably, the transmission means acting between the pedal means and the driving wheels involve a speed reduction so that the heavy-loaded rack may be moved with a reduced human power.

Figure 2:
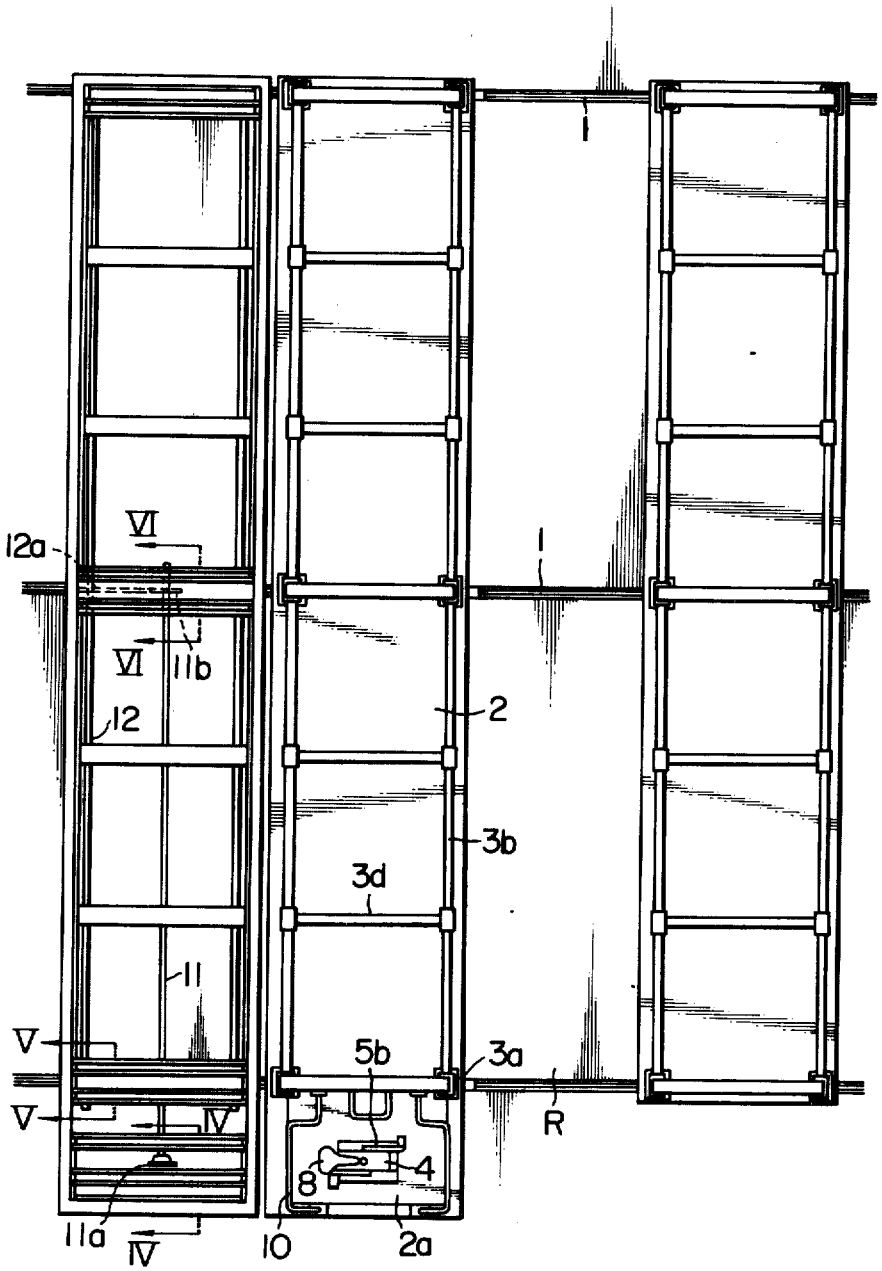

As will be seen from FIG. 2, a plurality of mobile racks are arrayed on the rails. When one of the racks is to be approached for loading and/or unloading, it is therefore necessary to make up a passage R for the access. To this end, the racks are optionally moved along the rails, leftward and rightward as viewed in FIG. 2. The switchable nature of the position of the saddle 8 is of a great help for the reversing of the racks.

Figure 3:
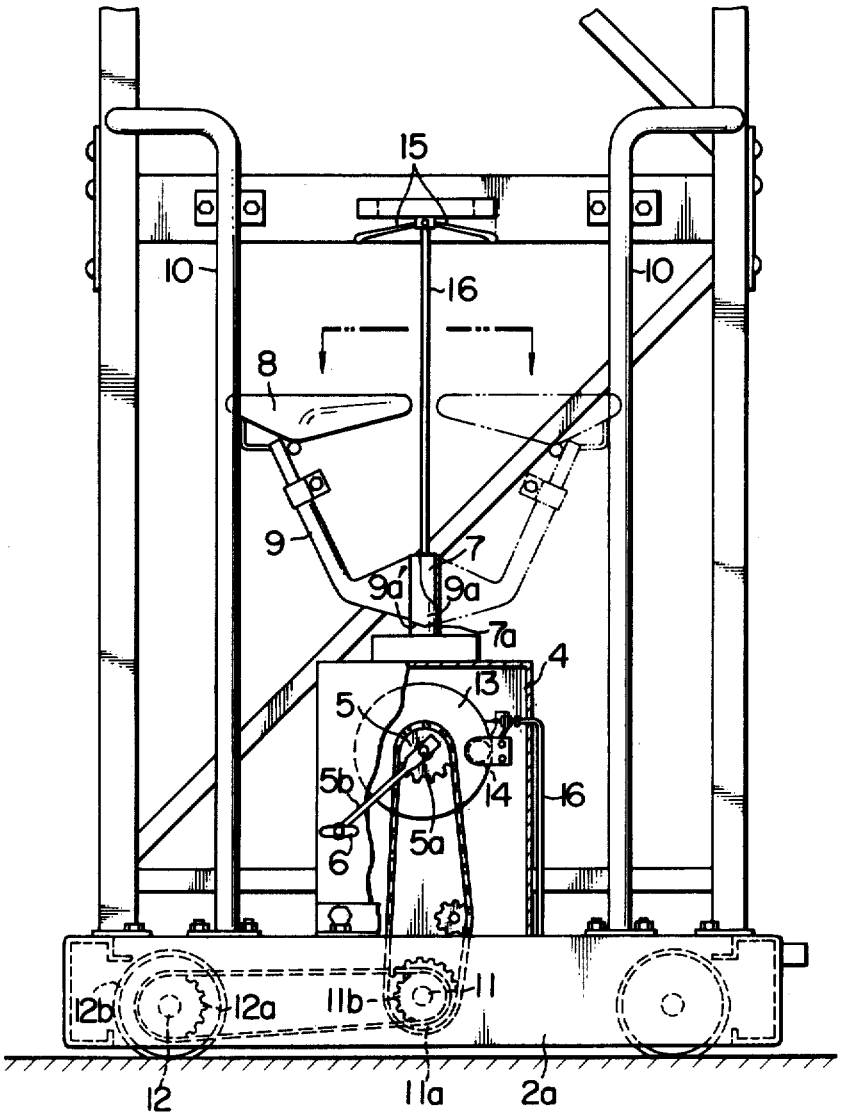

An excessively high speed of movement of the racks may cause a too large shock when the moving rack collides with a stationary rack, resulting in a collapse or falling down of the goods carried by the racks. Although the speed can be well controlled by the force exerted on the pedal, it is preferred to provide suitable braking means as shown in FIG. 3. The braking means would be effective also to prevent the racks from moving unintentionally and consequent collision of the racks and falling down of goods, especially when the rails are situated on an inclined plane.

More specifically, referring to FIG. 3, a disc 13 is fixed to the pedal actuated shaft 5a concentrically with the primary wheel 5. Braking pads 14 are arranged at both sides of the disc 13 for optionally cramping the peripheral portion of the latter. The pads are operatively connected, through a cable 16 or the like means, to a lever 15 which is properly located for an easy operation, e.g. on the central and upper portion of the frame as shown in FIG. 3. The arrangement is such that normally the braking pads 14 are resiliently pressed onto the periphery of the disc 13 to exert a slight braking force, but the disc 13 is released from the braking pads 14 to rotate freely when the lever 15 is gripped by the operator's hand. It will be seen that the braking means play the double roles of speed control and the prevention of unintentional movement of the racks out of use.

The V-shaped notches 9a' on the surface of the tubular member 9a for setting the saddle may be substituted by a combination of a key and a key groove provided between the pipe 7 and the tubular memver 9a. Also, the braking means can have any known construction other than the described combination of the braking disc and pads.

For informations, fork lifts and other known transporting machine can be moved into the passage R of FIG. 2 to handle goods of heavy weight.

In the foregoing embodiment, a combination of a braking disc and pads is used for braking the mobile racks.

In the second embodiment of the invention shown in FIGS. 7 through 10, specific braking means are incorporated to prevent accidents attributable to the unintentional movement of the racks out of use, which is possible to occur especially when the rails are inclined.

Referring to these drawings, a braking wheel 23 is fixed to the shaft 5a of the primary wheel 5 coaxially with the latter. An externally operative braking rod 24 is adapted to be brought into engagement with the teeth provided on the periphery of the braking wheel 23. The braking rod 24 loosely pass a bent edge 25a of a sub-plate 25 with which the box-shaped frame 4 is lined, and through a bent edge 26a of a guide plate 26 fixed to the sub-plate, for getting into and out of engagement with the teeth of the braking wheel. The braking rod 24 is connected to one of the arms of a bell crank 27 adapted to be rotated around a fulcrum shaft 27a. The other end of the bell crank 27 is connected to the lower end of an operating rod 29 which passes upwardly through a bore 28 formed in the top panel of the box-shaped frame 4.

Figure 9:
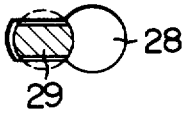
Figure 10:
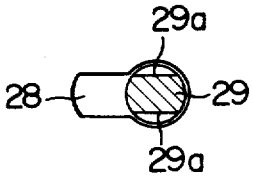

The operation rod 29 is notched at two opposite portions close to the upper end thereof, so as to present flattened surfaces 29a. The portion of the operating rod 29 at the flattened surfaces 29a has a cross-section as shown in FIGS. 9 and 10. The bore 28 has a keyhole - like shape consisting of a circular portion of a diameter slightly larger than that of the operating rod 29 and a notched portion joining to member circular portion. When the operating rod 29 is lifted manually by a knob 29b provided at the upper ends thereof and moved leftward as viewed in FIG. 8, the portion of the operating rod 29 at which the flat surfaces 29a are provided is allowed to move into the notched portion of the keyhole-shaped bore 28, as shown in FIG. 9, so as to prevent the operating rod 29 from being lowered. This movement of the operating rod 29 causes a counterclockwise rotation of the bell crank 27 which in turn causes a rightward sliding movement of the braking rod 24 out of engagement with the teeth of the braking wheel 23. When the rack is to be kept stationary, the knob 29b of the operating rod 29 is moved rightward as viewed on FIG. 8, so that the flattened portion of the operating rod 29 comes out of engagement with the notched portion of the bore 28. Consequently, the operating rod 29 is allowed to be lowered due to its weight, causing a clockwise rotation of the bell crank 27 which in turn forces the braking rod 24 leftwardly into engagement with the teeth of the braking wheel 23.

Therefore, the braking wheel 23 is kept stationary against rotation so as to exert a braking force on the shaft 5a and, accordingly, on the driving wheels connected to the shaft 5a by means of transmission means including the primary wheel and the belt or chain. The rack therefore cannot move against the operator's will, and the aforementioned accidents are fairly avoided.

Figure 8:
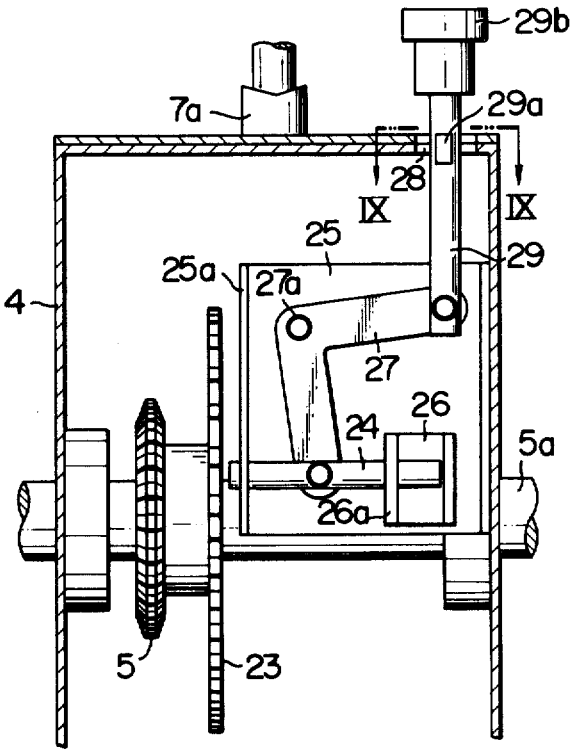

Preferably, a spring adapted to bias the bell crank 27 clockwisely as viewed on FIG. 8 is incorporated in the braking system constituted by the operating rod 29, the bell crank 27 and the braking rod 24.

The braking system may be substituted by a mechanism which affords a direct operation of the braking rod externally of the box-shaped frame 4. At the same time, the braking system may be such that the braking rod is moved in a direction perpendicular to the axis of the braking wheel.

In the foregoing embodiments, the mobile racks have been described to have their own driving system. However, as mentioned before, the mobile rack system of the invention may have a separate driving system adapted to pull the racks.

Figure 11:
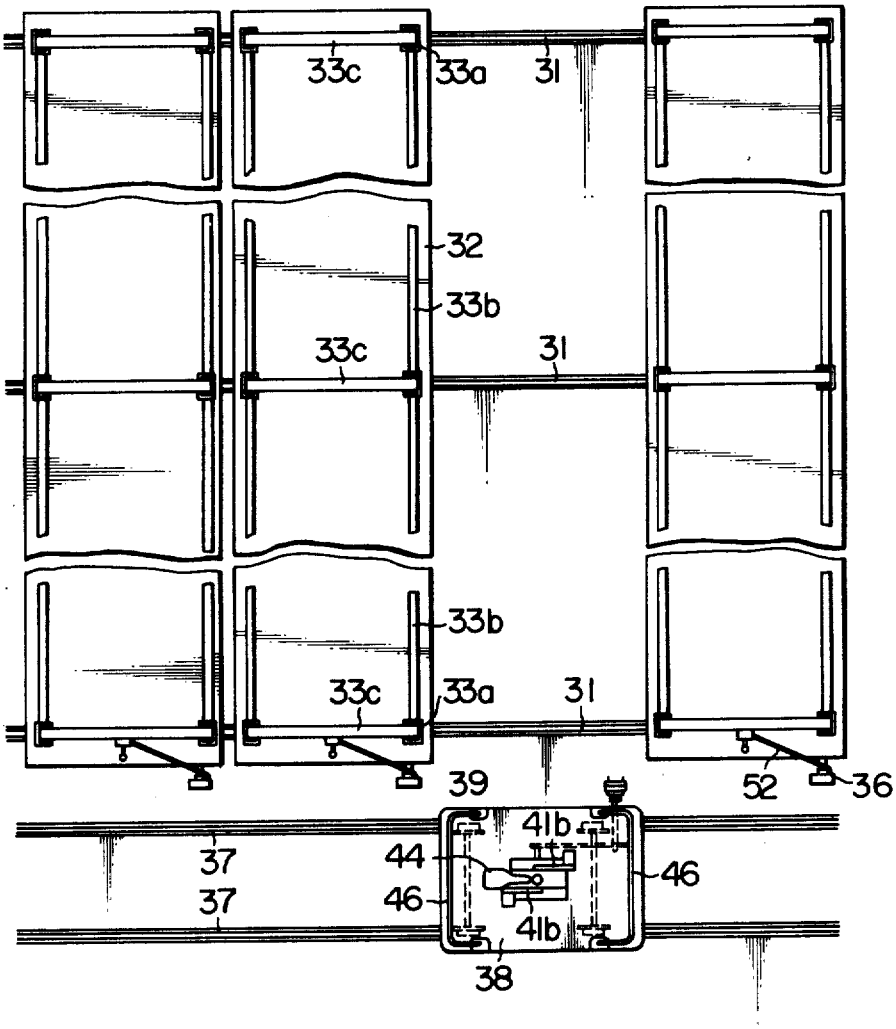
Figure 12:
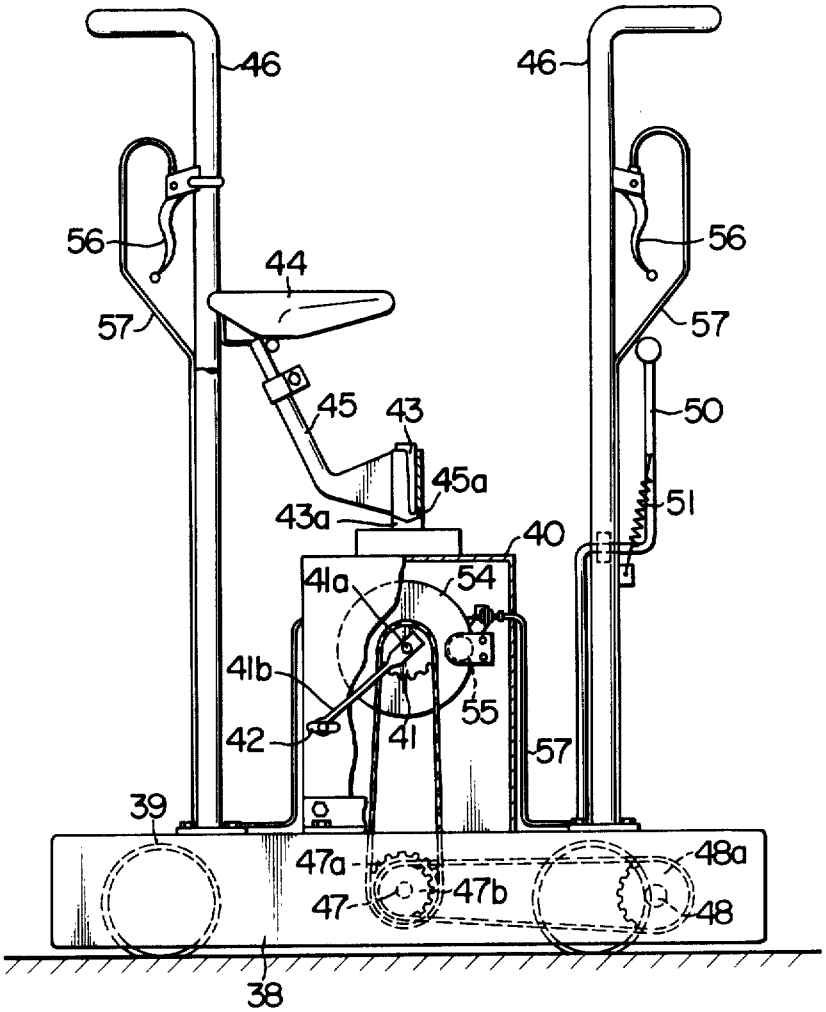
Figure 13:
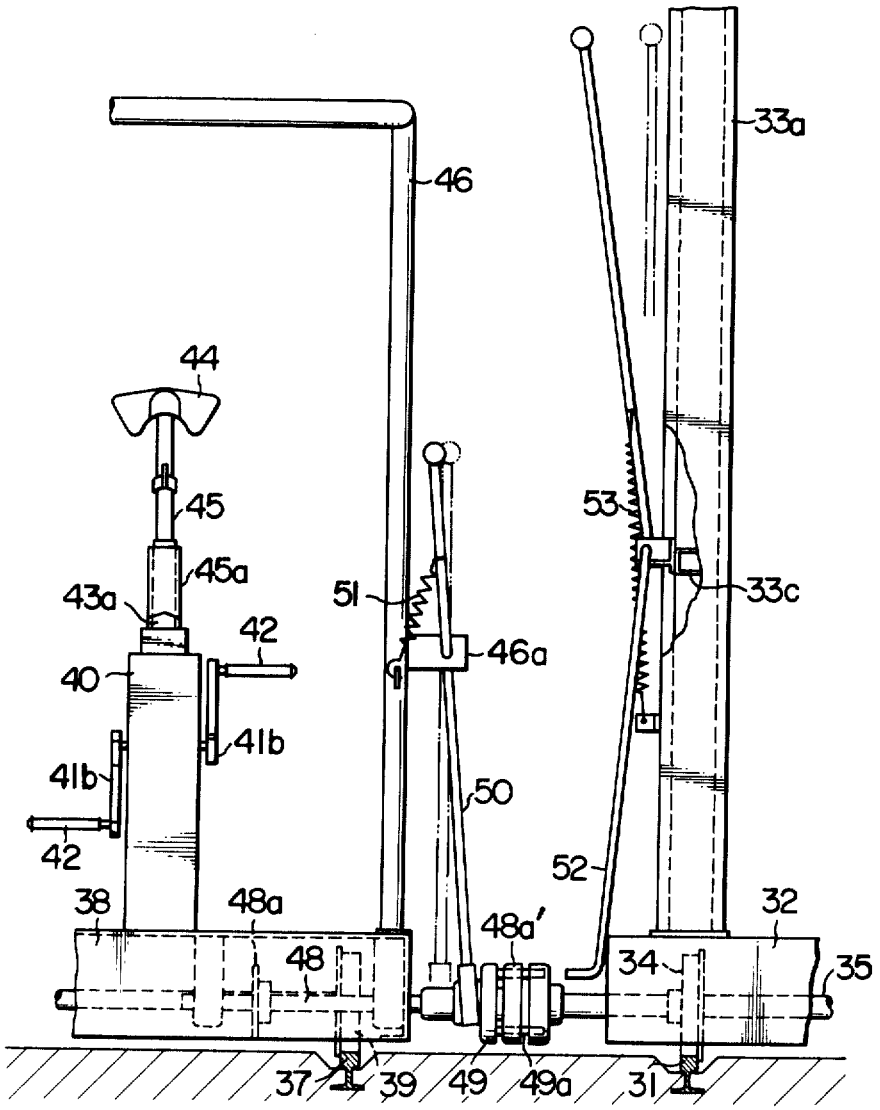

FIGS. 11 to 13 show a third embodiment of the invention in which the mobile racks are adapted to be moved by a separate driving system, i.e. a tractor.

Referring to FIG. 11, there are shown three units of mobile racks adapted to run along parallel rails 31 laid on a floor. The mobile rack has a base 32 in the form of an inversed shallow box (See FIG. 13), and has a frame-like structure consisting of pillars 33a extending upwardly from the base 32, beams 33b and reinforcing girders. Load supporting members 33c on which the goods to be stored are mounted are provided to bridge the beams 33b. The rack is provided at its bottom with wheels 34 adapted to roll on the rails 31, as will be seen most clearly from FIG. 13. The wheels 34 are carried by respective shafts 35 having one end projecting out of the base 32 for carrying a driven wheel 36 of a clutch. The driven wheel of the clutch is provided with a number of bores formed along the periphery thereof. Another pair of rails 37 are laid in parallel with the aforementioned rails 31 for the mobile racks. The rails 37 carry a pedal actuated vehicle or a tractor having a base 38 and wheels 39 provided at the bottom of the base 38. Thus, the tractor can freely run along the rails 37, independently of the mobile racks, by means of the wheels 39. As will be seen from FIG. 12, the base 38 of the tractor carries pedal means driving the tractor. More specifically, the base 38 carries a box-shaped frame 40 having no bottom. A pair of opposing walls of the frame 40 are passed by a shaft 41a of a primary wheel 41. A pair of crank arms 41b are fixed to respective ends of the shaft 41a. The crank arms carry at their free ends respective pedals 42 similar to those of bicycles. A vertical pipe 43 is fixed to the center of the top panel of the frame 40 to extend upwardly therefrom. A tubular member 45a which is unitary with a support 45 for a saddle 44 if loosely fitted around the pipe 43. The arrangement is such that the support 45 along with the saddle 44 can be freely rotated around the pipe 43 as desired. For fastening the saddle at positions convenient for the operator's effort on the pedal means, in the illustrated embodiment, the tubular member 45a has a lower surface notched to provide a pair of V-shaped projections, while an enlarged base portion 43a of the pipe 43 has an upper surface notched to receive the V-shaped projections. Therefore, the saddle can be switched from the position of FIG. 12 to the opposite position by at first lifting, rotating through 180° and then lowering the saddle. It will be seen that the saddle is fastened at the new position against movement due to a new engagement of the V-shaped projections and corresponding notches.

Behind the respective positions of the saddle, there are provided hand rails 46 which play also the role of a seat back. The rotation of the shaft 41a caused by the operator's effort on the pedal means is transmitted, through a chain or a belt, to an intermediate wheel 47a on a shaft 47, and then, further to a wheel 48a on an output shaft 48 through a chain or a belt. The output shaft 48 is supported on the base 38 in parallel with and at the same height with the shaft 35 for the running wheels.

The output shaft 48 projects at its one end out of the wall of the base 38 to carry a guide wheel 48a' having a shape similar to that of the driven wheel 36 of the clutch carried by the shaft 35 on the mobile rack. The guide wheel 48a' is provided with a number of peripheral bores for building a corresponding number of a pins 49a of a driving wheel 49 of the clutch. The driving wheel 49 is slidably mounted on the output shaft 48. The guide wheel 48a' conveniently prevents the driving wheel from being disengaged.

A shift lever 50 is supported on each hand rail by a support 46a, for free swinging movement in a vertical plane. The shift lever 50 has a forked lower end loosely fitted to a peripheral groove on the driving wheel 49. The shift lever 50 is normally biased leftward as viewed on FIG. 13, by means of a spring 51 stretched between the upper portion of the lever and the hand rail 46.

In the illustrated condition, the driving wheel 49 of the clutch is biased rightward. At the same time, a brake lever 52 of a structure similar to that of the shift lever is rotatably supported on one of the load carrying girders 33c of the rack frame at a suitable height. The brake lever 52 has an upper and a lower arms and is so associated with a toggle spring 53 as to assume the positions illustrated by full line and chain line in FIG. 13. When the braking lever assumes the position of the chain line, a bent lower end of the lower arm thereof is put into one of the peripheral bores formed in the driven wheel 36 of the clutch to prevent the rack from being moved unintentionally. The bent end of the lower arm is disengaged from the peripheral bore to allow the running of the rack, as the braking lever 52 is returned to the position of full line.

In operation, at first the tractor is solely moved to bring the output shaft 48 into alignment with the running wheel 35 of the rack. Then, the shift lever 50 is slided rightward to put the pins 49a on the driving wheel 49 of the clutch into engagement with the peripheral bores of the driven wheel 36 of the clutch. During this motion of the clutch, one of the pins automatically forces out the bent end of the lower arm of the braking lever from the bore of the driven wheel 36. Consequently, the braking lever 52 is moved leftward as viewed on FIG. 13, and is automatically returned to the position of full line as it passes a dead point of the toggle spring 53.

Subsequently, an effort is made on the pedal means by the operator. The rotation of the shaft 41*a* is transmitted through the speed reduction transmitting mechanism constituted by the primary wheel 41, intermediate wheels 47*a*, 47*b* and 48, and by the chain or belts stretched therebetween. The speed reduction performed by the transmission mechanism provides a correspondingly increased torque which is then transmitted to the running wheels 45 of the frame through the clutch. Therefore, the rack can be moved by a reduced human power exerted on the pedal means, even when it is loaded with heavy load.

As shown in FIG. 11, the racks are usually arrayed close to each other. Therefore, for loading and/or unloading a specific rack, it is required to move the racks leftward or rightward, to make up a passage for access the destined rack. The switching nature of the position of the saddle is convenient for the reversing of the racks.

It will be seen that an excessively high speed of movement of the rack would cause a collision of racks and a consequent falling down of the goods and other inconveniences. Although the speed can be controlled by means of the force exerted on the pedal means, it is preferred to employ a braking means as shown in FIG. 12 consisting of a brake disc 54 and a pair of cooperating brake discs 55, similar to that of the first embodiment. Since this braking means perform a similar function with those of the first embodiment, no further explanation will be needed here.

As mentioned before, it will be a better policy to use a fork lift or the like transportation machine for handling goods of large weight. Therefore, the rails for the racks and tractor are preferably embedded to the floor so that they assume the same height with the floor, for allowing the fork lift to enter the passage formed between the racks, as shown in FIG. 13.

As the same time, the speed reduction mechanism which has been described to be mounted on the tractor may be provided on the frame rack.

Having described the invention through specific preferred embodiments by way of examples, it is to be noted here that various changes and modifications may be imparted thereto without departing from the spirit and scope of the invention which is delimited solely by the appended claims.

What is claimed is:

1. A mobile rack system comprising:
(a) a plurality of rails;
(b) a plurality of mobile racks mounted on said rails for movement along said rails;
(c) at least one driving means for driving said mobile racks along said rails, said driving means including manually operated pedal means for supplying the driving power to said driving means,
(d) said at least one driving means is a plurality of driving means and one of said driving means is provided on each of said mobile racks; and
(e) said pedal means includes a pair of pedals, mounted on a shaft, on which the manual power is exerted, and said driving means includes a saddle for the operator, the position of which is switchable in accordance with the direction of the movement of the mobile rack, at least a pair of driving wheels mounted on a shaft provided on said mobile rack for rolling on said rails, and a speed reduction transmission mechanism through which the shaft of said pedals is connected to the shaft of said driving wheels.

2. A mobile rack system as claimed in claim 1, wherein each of said mobile racks is provided with braking means for preventing said mobile rack from being moved unintentionally.

3. A mobile rack system as claimed in claim 1, wherein said braking means comprise a braking disc coaxially fixed to said shaft of said pedals and a pair of manually operated braking pads adapted to be selectively brought into frictional engagement with said braking disc.

4. A mobile rack system as claimed in claim 1, wherein said braking means comprise a toothed wheel coaxially fixed to the shaft of said pedals, a braking rod capable of engaging the teeth of said toothed wheel, and lever means for selectively bringing said braking rod into and out of engagement with said teeth.

5. A mobile rack system comprising:
(a) a plurality of rails;
(b) a plurality of mobile racks mounted on said rails for movement along said rails;
(c) at least one driving means for driving said mobile racks along said rails, said driving means including manually operated pedal means for supplying the driving power to said driving means;
(d) said driving means is a tractor adapted to run on a separate pair of rails, and adapted to pull said mobile rack; and
(e) said pedal means includes a pair of pedals mounted on a shaft on which manual power is exerted, and said tractor means includes at least a pair of driving wheels mounted on a shaft and adapted to roll on said separate rails, a speed reduction transmission mechanism through which said shaft of said pedals is connected to the shaft of said driving wheels, a saddle for an operator to sit on the position of which being switchable in relation to the direction of movement of said tractor, a clutch for selectively transmitting the driving power obtained through said transmission mechanism to one of the wheels of said mobile rack.

6. A mobile rack system as claimed in claim 5, wherein said clutch comprises an output shaft connected to the output side of said transmission mechanism, a driving wheel axially slidably mounted on said output shaft and carrying a plurality of axially extending pins, a guide wheel fixed to said shaft and having a plurality of bores corresponding to the number of said pins, and means for selectively moving said driving wheel of said clutch axially to bring said pins into engagement with bores formed in a driven wheel fixed to the shaft of wheels of said mobile rack through said guide wheel.

7. A mobile rack system as claimed in claim 5, wherein said tractor includes braking means for selectively braking the movement of said tractor.

* * * * *